United States Patent [19]

Koke

[11] Patent Number: 4,517,703

[45] Date of Patent: May 21, 1985

[54] HAIR BRUSH WITH CLEANING FEATURE

[76] Inventor: Eric J. Koke, Pleasant View Dr., Apt. 28-B, Piscataway, N.J.

[21] Appl. No.: 613,433

[22] Filed: May 24, 1984

[51] Int. Cl.[3] ..... A46B 17/06

[52] U.S. Cl. ..... 15/246; 15/104.5; 15/187; 132/119; 119/88

[58] Field of Search ..... 15/159 R, 169, 184, 15/186, 187, 188, 246, 104.5–104.54; 132/119; 119/88

[56] References Cited

U.S. PATENT DOCUMENTS

| | | | |
|---|---|---|---|
| 2,437,298 | 3/1948 | Heyman | 132/119 X |
| 2,553,242 | 5/1951 | Dombitsky | 15/104.51 |
| 4,001,910 | 1/1977 | Peilet | 132/119 X |

FOREIGN PATENT DOCUMENTS

| | | | |
|---|---|---|---|
| 232828 | 11/1910 | Fed. Rep. of Germany | 132/119 |
| 471561 | 11/1914 | France | 132/119 |

*Primary Examiner*—Peter Feldman

*Attorney, Agent, or Firm*—Arthur L. Lessler

[57] ABSTRACT

A hair brush having a foraminous guide plate with holes through which the bristles extend. The bristles have enlarged bulbous free ends, and the holes in the guide plate are larger than the stems of the bristles but smaller than the enlarged ends thereof, so that the guide plate can slide along the bristles but cannot be removed. A laminated cleaning plate has a rubber layer with bristle-receiving holes smaller than the stems of the bristles, so that the holes in the rubber layer tightly engage the bristles. The cleaning plate also has a relatively rigid support sheet with bristle-receiving holes larger than the enlarged ends of the bristles. The rubber layer is bonded to the support sheet, so that the cleaning plate can be entirely removed from the bristles for cleaning purposes, while the guide plate can be brought adjacent the free ends of the bristles to facilitate re-installation of the cleaning plate.

2 Claims, 4 Drawing Figures

FIG. 2
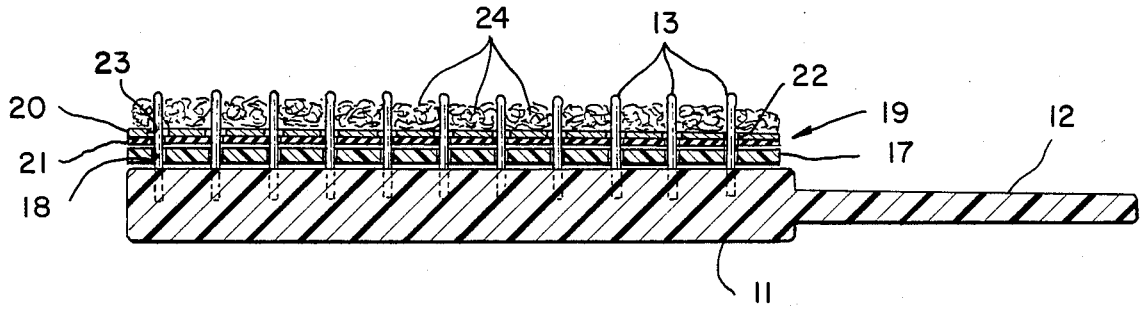
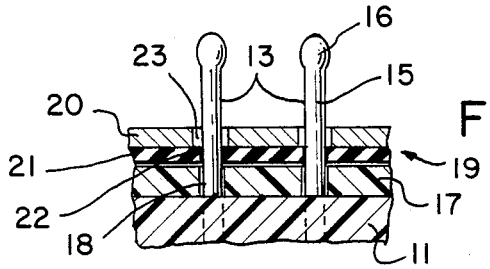
FIG. 3
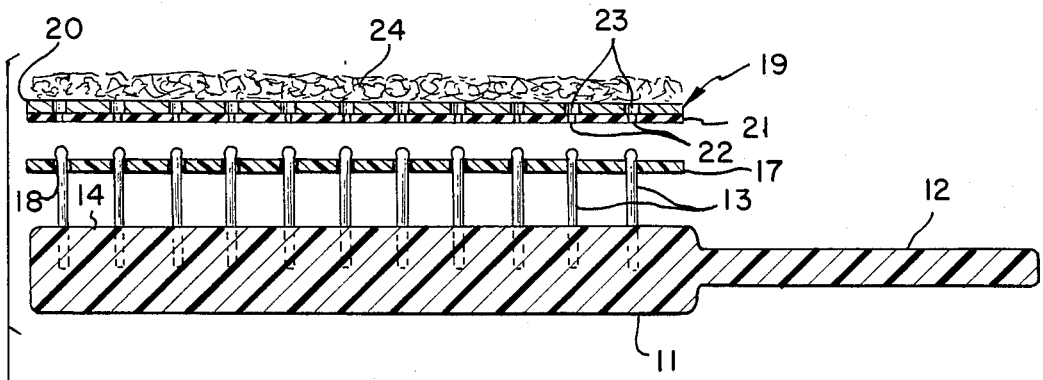
FIG. 4

HAIR BRUSH WITH CLEANING FEATURE

BACKGROUND OF THE INVENTION

This invention relates to a hair brush of the type having a member slidably moveable along the bristles thereof, for the purpose of cleaning the brush by removing hair therefrom.

Hair brushes of this type, for use on both humans and animals, are well known in the art. Such brushes are exemplified by the following U.S. Pat. No. 2,529,927 to Fisk No. 3,108,305 to Peilet No. 3,110,053 to Surabian No. 1,290,554 to Healey No. 1,050,103 to Clemens No. 1,164,204 to Mullett et al.

In the arrangement of Fisk a foraminous cleaning plate 11 has holes through which the bristles extend. The cleaning plate is slidable movable along the bristles, and is prevented from being removed from the ends of the bristles by hooks 13 which are secured to opposite ends of the cleaning plate and which also engage the base of the brush. The other arrangements described in the aforementioned references similarly employ various mechanisms to limit the movement of the cleaning plate, and some employ additional mechanisms to return the cleaning plate to its rest position adjacent the base of the brush.

Such prior art arrangements are relatively complex and expensive to manufacture, and are susceptible to jamming and other mechanical malfunctions.

Accordingly, an object of the present invention is to provide an improved hair brush having a cleaning feature, and employing a relatively simple and reliable construction.

SUMMARY OF THE INVENTION

As herein described, there is provided a hair brush having a foraminous guide plate with holes through which the bristles extend. The bristles have enlarged free ends, and the holes in the guide plate are larger than the stems of the bristles but smaller than the enlarged ends thereof, so that the guide plate can slide along the bristles but cannot be removed. A laminated cleaning plate has a layer of resilient material with bristle-receiving holes smaller than the stems of the bristles, so that the holes in the rubber layer tightly engage the bristles. The cleaning plate also has a relatively rigid support sheet with bristle-receiving holes larger than the enlarged ends of the bristles. The resilient layer is bonded to the support sheet, so that the cleaning plate can be entirely removed from the bristles for cleaning purposes, while the guide plate can be brought adjacent the free ends of the bristles to facilitate re-installation of the cleaning plate.

BRIEF DESCRIPTION OF THE DRAWING

FIG. 2 is a side cross-sectional view of said hair brush, showing the guide plate and cleaning plate thereof in the normal usage position of the brush;

FIG. 3 is an enlarged view of a portion of FIG. 2; and

FIG. 4 is a side cross-sectional view of said hair brush, showing the cleaning plate removed and the guide plate in position for facilitating re-installation of the cleaning plate.

DETAILED DESCRIPTION OF THE PREFERRED EMBODIMENT

Figure 1:
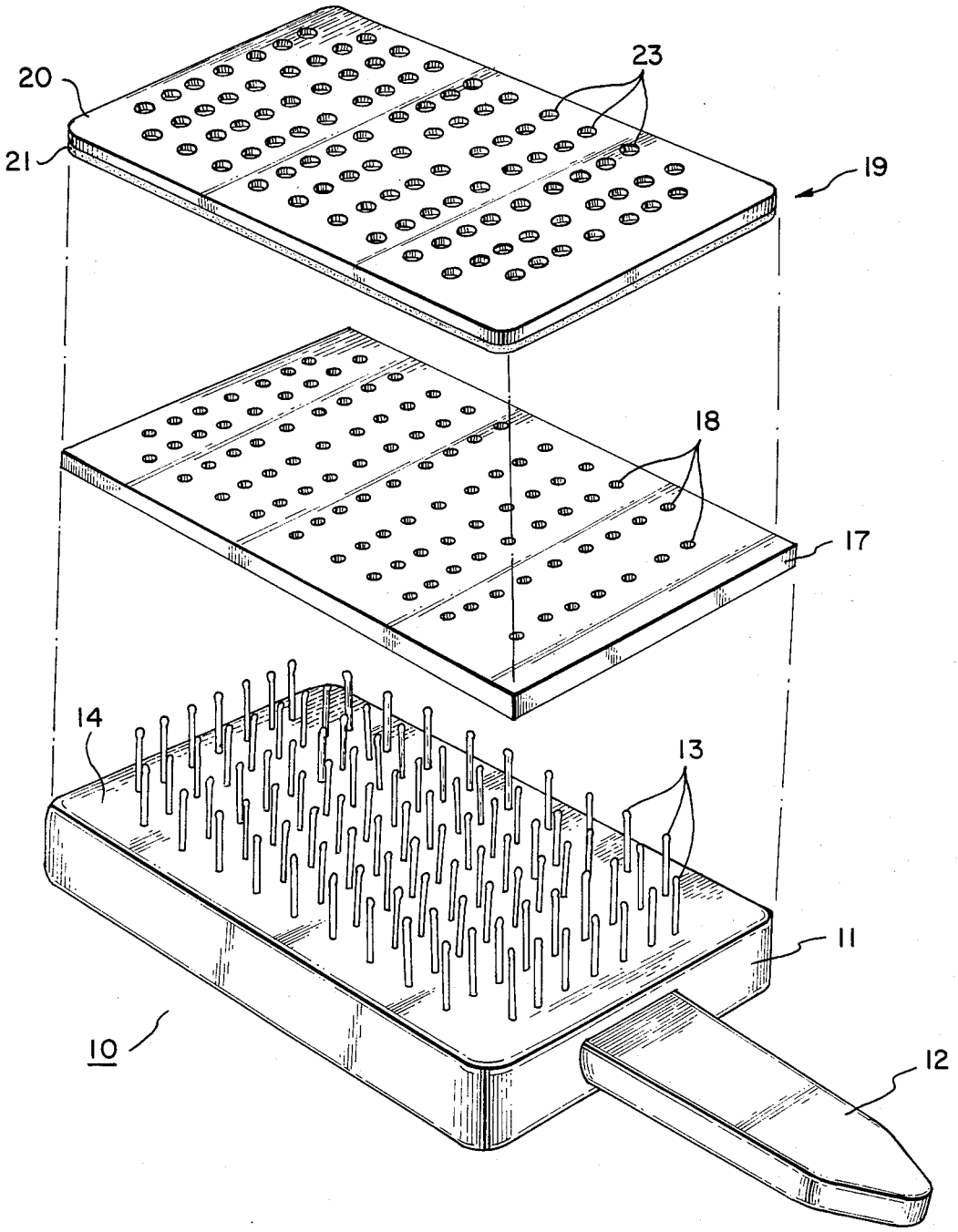
FIG. 1 is an exploded isometric view of a hair brush according to a preferred embodiment of the invention.

The hair brush 10 has a base 11 and a handle 12. A multiplicity of parallel bristles 13 extends from the bristle-holding surface 14 of the base 11, one end of each of the bristles 13 being embedded in the base 11. The base 11 is preferably made of plastic.

As best seen in FIG. 3, each bristle has a cylindrical stem 15 and an enlarged bulbous free end 16. The bristles may be made of plastic or metal wire, and may have varying stem and free end diameters. Preferably, however, the bristles should be of approximately equal length.

The enlarged bulbous ends of the bristles provide stimulation to the skin being combed, while reducing the risk of irritation thereto which might be caused by sharp bristle ends.

A foraminous guide plate 17 has a multiplicity of holes 18 therein through which corresponding ones of the bristles 13 extend. The guide plate 17 may be made of metal or plastic, a plastic such as acrylonitrile-butadiene-styrene being preferred.

As best seen in FIG. 3, each of the holes in the guide plate 17 has a diameter larger than that of the stem of the corresponding bristle but smaller than that of the enlarged bulbous end of the corresponding bristle, so that guide plate 17 can slide along the bristles between the surface 14 of the base 11 and the free bristle ends 16; but cannot be entirely removed from the bristles.

A removable laminated cleaning plate 19 consists of a relatively rigid support sheet 20 to which is bonded a layer 21 of rubber or any other suitable resilient material. The support sheet 20 may be made of metal or plastic, a plastic such as acrylonitrile-butadiene-styrene being preferred.

The rubber layer 21 has bristle-receiving holes 22 aligned in a pattern corresponding to the pattern of the bristles 13. Each bristle-receiving hole 22 in the rubber layer 21, when the layer is unstressed, is smaller in diameter than the stem of the corresponding bristle, so that the holes 22 in the rubber layer 21 tightly engage the bristles 13 when the cleaning plate is installed on the bristles, as shown in FIG. 2.

The resiliency of the rubber layer 21 is sufficient so that the holes 21 can stretch over the enlarged bulbous free ends 16 of the bristles 13, to enable removal and re-installation of the cleaning plate 19.

The support sheet 20 has holes 23 concentric with the holes in the rubber layer 21, each of the holes 23 in the support sheet 20 having a diameter greater than that of the enlarged bulbous free end of the corresponding one of the bristles 13, so that the support sheet 20 does not interfere with removal and re-installation of the cleaning plate 19.

When the brush 10 is in use, the guide plate 17 is against the bristle-holding surface 14 of the base 11; and the cleaning plate 19 is against the guide plate 17. The cleaning plate can be installed in either orientation, i.e. either with the support sheet 20 exposed as shown in the drawing, or with the rubber layer 21 exposed.

When the rubber layer 21 is exposed, a slight improvement in ease of cleaning may be realized since hair 24 and dirt particles are prevented from entering the holes 23 in the support sheet, due to the tight engagement of the bristles 13 by the peripheral surfaces of the holes 22 in the rubber layer 21. Similarly, re-installation of the cleaning plate 19 is slightly easier with the support sheet 20 facing the base 11, since the relatively large holes 23 (as compared with the holes 22) facilitate alignment of the holes in the cleaning plate with the bristles.

However, it is easier to wipe hair and dirt off the relatively hard exposed surface of the support sheet 20 than to remove it from the relatively soft exposed surface of the rubber layer 21.

Therefore the orientation of the cleaning plate 19 may be varied by the user depending upon which of the aforementioned factors is most important for the particular application involved.

When it is desired to clean the brush 10 to remove the accumulated hair 24 and dirt particles, the guide plate 17 is slid along the bristles 13 to a position (shown in FIG. 4) adjacent the enlarged bulbous free ends 16 thereof, and the cleaning plate 19 is removed.

After wiping any remaining hair 24 and dirt from the cleaning plate 19, it is re-installed on the bristles 13, with the guide plate 17 serving to hold the free ends of the bristles 13 in their proper orientation so as to facilitate the reinstallation. Thereafter the cleaning plate 19 and guide plate 17 are pressed toward the base 11 to return the brush to its normal use position shown in FIG. 2.

I claim:

1. A hair brush having a cleaning feature, comprising:

a base having a multiplicity of parallel bristles extending from a bristle-holding surface thereof, each bristle having a cylindrical stem and an enlarged bulbous free end;

a foraminous guide plate disposed adjacent said bristle-holding surface of said base and having holes through which corresponding ones of said bristles extend, each hole in the guide plate being larger in diameter than the stem of the corresponding bristle and smaller in diameter than the enlarged bulbous end of said corresponding bristle, so that the guide plate can slide along the bristles but cannot be removed therefrom; and a laminated cleaning plate having a layer comprising resilient material with bristle-receiving holes aligned in a pattern conforming to the pattern of said bristles, each hole in said resilient layer, when unstressed, being smaller in diameter than the stem of the corresponding bristle, so that the holes in the resilient layer can tightly engage the bristles, said cleaning plate also having a relatively rigid support sheet with bristle-receiving holes coaxial with the holes in said resilient layer, said bristle-receiving holes being larger in diameter than the enlarged bulbous ends of the bristles, said resilient layer being bonded to the support sheet, whereby the cleaning plate can be entirely removed from the bristles for cleaning purposes, while the guide plate can be brought adjacent the free ends of the bristles to facilitate re-installation of the cleaning plate thereon.

2. A hair brush having a cleaning feature, comprising:

a base having a multiplicity of parallel bristles extending from a bristle-holding surface thereof, each bristle having a generally cylindrical stem and an enlarged free end;

a foraminous guide plate disposed adjacent said bristle-holding surface of said base and having holes through which corresponding ones of said bristles extend, each hole in the guide plate being larger in diameter than the stem of the corresponding bristle and smaller in diameter than the enlarged end of said corresponding bristle, so that the guide plate can slide along the bristles but cannot be removed therefrom; and a cleaning plate having a layer comprising resilient material with bristle-receiving holes aligned in a pattern conforming to the pattern of said bristles, each hole in said resilient layer being adapted to tightly engage the corresponding bristle, said cleaning plate also having a relatively rigid support sheet with bristle-receiving holes coaxial with the holes in said resilient layer, said bristle-receiving holes being larger in diameter than the enlarged ends of the bristles, said resilient layer being secured to the support sheet, whereby the cleaning plate can be entirely removed from the bristles for cleaning purposes, while the guide plate can be brought adjacent the free ends of the bristles to facilitate re-installation of the cleaning plate thereon.

* * * * *